US006583393B1

(12) United States Patent
Ota

(10) Patent No.: US 6,583,393 B1
(45) Date of Patent: Jun. 24, 2003

(54) INDUCTION HEATING FIXING DEVICE WITH AN EXTENDED PRESSURE CONTACT AREA FOR USE WITH MAGNETIC TONER

(75) Inventor: Hiroshi Ota, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/050,936

(22) Filed: Jan. 22, 2002

(51) Int. Cl.[7] ..... H05B 6/14; G03G 15/20

(52) U.S. Cl. ..... 219/619; 219/659; 399/328; 399/330

(58) Field of Search ..... 219/619, 659, 219/653; 399/328, 329, 330, 331, 332

(56) References Cited

U.S. PATENT DOCUMENTS

| | | | | |
|---|---|---|---|---|
| 6,037,576 | A * | 3/2000 | Okabayashi et al. | 219/619 |
| 6,078,780 | A * | 6/2000 | Abe et al. | 399/328 |
| 6,263,172 | B1 * | 7/2001 | Suzuki et al. | 219/619 |
| 2001/0022909 | A1 * | 9/2001 | Takeuchi et al. | 399/328 |
| 2002/0048713 | A1 * | 4/2002 | Komoto et al. | 399/331 |

FOREIGN PATENT DOCUMENTS

| | | |
|---|---|---|
| JP | 10-83883 | 3/1998 |
| JP | 2001-343784 | * 12/2001 |

* cited by examiner

*Primary Examiner*—Philip H. Leung
(74) *Attorney, Agent, or Firm*—Foley & Lardner

(57) ABSTRACT

An induction fixing device is provided which uses a magnetic toner for image formation but is easy to reproduce a true image while preventing the toner from being moved even if influenced by a magnetic field generated for induction heating. In the induction heating fixing device of the present invention, a pressure contact area DS, through which a sheet of printing paper having a pattern of a magnetic toner is conveyed with the magnetic toner being fixed to the printing paper under the action of induction heating, is set to be broader than a range in which the magnetic toner receives a force that causes it to move under the influence of a magnetic field generated by an induction heating means 25. With this arrangement, when the printing paper is conveyed to reach a place where the magnetic toner on the surface of the printing paper is subjected to a moving force due to the magnetic field from the induction heating means 25, pressure has already been applied to the magnetic toner by a pressurizing means 10, 14, 20 so as to prevent movement of the magnetic toner. Thus, a true image can be easily reproduced without movement of the magnetic toner at the time of induction heating.

6 Claims, 2 Drawing Sheets

INDUCTION HEATING FIXING DEVICE WITH AN EXTENDED PRESSURE CONTACT AREA FOR USE WITH MAGNETIC TONER

BACKGROUND OF THE INVENTION

1. Field of the Invention

The present invention relates to a fixing device of a copying machine or the like, and more particularly, it relates to an induction heating fixing device which includes a pressurizing means for applying pressure to a sheet of printing paper in a pressure contact area, through which the printing paper having a pattern of a magnetic toner transferred to a surface thereof is conveyed, and an induction heating means for induction heating the magnetic toner on the surface of the printing paper, which is being conveyed through the pressure contact area, so as to fix the pattern of the magnetic toner onto the surface of the printing paper.

2. Description of the Related Art

In known copying machines or the like, as disclosed in Japanese Patent Application Laid-Open No. 10-83883 for example, a fixing device operates to place a heating mechanism into contact with a toner, which formed into a pattern on a sheet of printing paper, so as to heat the toner, and at the same time, to apply pressure to the toner by means of a pressurizing mechanism, thereby fixing the toner to the printing paper. This technique uses a halogen lamp or the like for heating, but thermal efficiency thereof is not good. In recent years, there has been made a proposal for using a magnetic toner, which can be made to generate heat by itself under the action of a magnetic field, and hence has excellent thermal efficiency.

With the induction fixing device that carries out fixing by the use of the above-mentioned magnetic toner, thermal efficiency or the like is excellent and energy consumption can be suppressed to a low level, but the magnetic toner would be subjected to the influence of a magnetic field generated for induction heating, so that it can receive a force that causes it to move. Accordingly, there is a problem that it is not easy to reproduce a true image.

SUMMARY OF THE INVENTION

The present invention is intended to obviate the above-mentioned problem, and has for its object to provide an induction fixing device which uses a magnetic toner for image formation but is easy to reproduce a true image while preventing the magnetic toner from being moved even if influenced by a magnetic field generated for induction heating.

In order to solve the above-mentioned problem, the present invention resides in an induction heating fixing device including: a pressurizing means for applying pressure to a sheet of printing paper in a pressure contact area, through which the printing paper having a pattern of a magnetic toner transferred to a surface thereof is conveyed; and an induction heating means for induction heating the magnetic toner on the surface of the printing paper, which is being conveyed through the pressure contact area, so as to fix the pattern of the magnetic toner onto the surface of the printing paper. The pressure contact area is set to be broader than a range in which the magnetic toner on the surface of the printing paper is subjected to a force that causes it to move under the action of a magnetic field from the induction heating means.

With such an arrangement, the pressure contact area, through which the printing paper having the pattern of the magnetic toner is conveyed with the magnetic toner being fixed to the printing paper under the action of induction heating, is set to be broader than a range in which the magnetic toner receives a force that causes it to move under the influence of a magnetic field generated by the induction heating means. As a result, when the printing paper is conveyed to reach a place where the magnetic toner on the surface of the printing paper is subjected to a moving force (magnetic force) due to the magnetic field from the induction heating means, pressure has already been applied to the magnetic toner by the pressurizing means so as to prevent movement of the magnetic toner. Therefore, fixing of the magnetic toner is carried out without any movement thereof, thus making it possible to easily reproduce a true image.

Moreover, in this invention, the pressurizing means is formed of a non-conductive material which is not heated even if subjected to the magnetic field from the induction heating means. With this arrangement, it is possible to avoid consuming energy uselessly.

In addition, in the present invention, the pressurizing means includes a first and a second pressurizing belt of an endless belt configuration, and a pressurizing mechanism disposed in the first pressurizing belt. The second pressurizing belt is driven to rotate in a feeding direction while carrying the printing paper thereon. The first pressurizing belt is driven to rotate with the printing paper placed between the first and second pressurizing belts. The pressurizing mechanism applies pressure to the magnetic toner at least in the pressure contact area in such a manner that the magnetic toner on the surface of the printing paper placed between the first and second pressurizing belts is prevented from being moved under the action of the magnetic field from the induction heating means.

Further, in the present invention, the induction heating means is disposed in the second pressurizing belt in an opposed relation with the first and second pressurizing belts interposed therebetween.

DESCRIPTION OF THE PREFERRED EMBODIMENT

Figure 1:
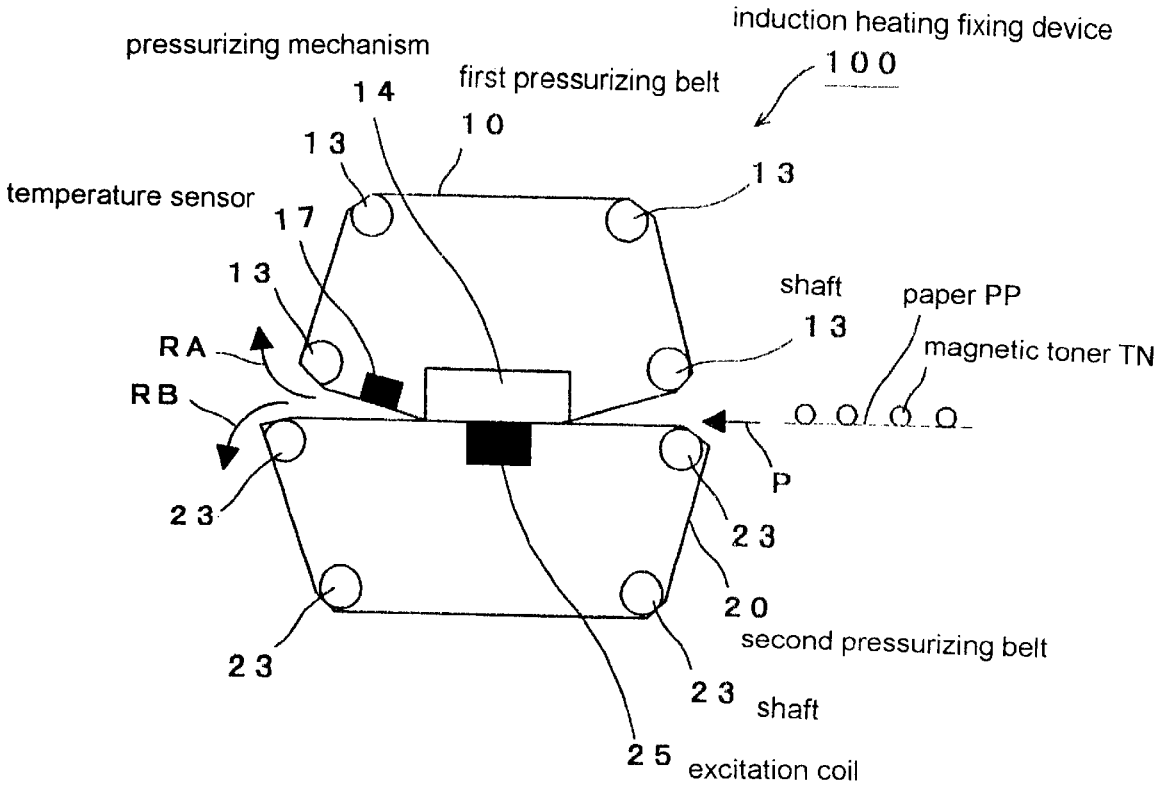
FIG. 1 is a cross sectional view illustrating an embodiment of an induction heating fixing device according to the present invention.
Figure 2:
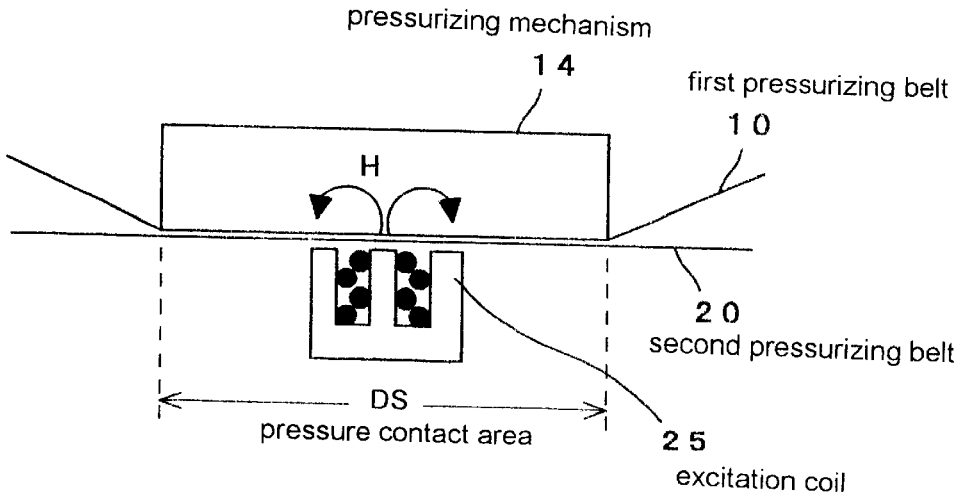
FIG. 2 is an enlarged cross sectional view illustrating the part of an excitation coil of FIG. 1 in detail.
Figure 3:
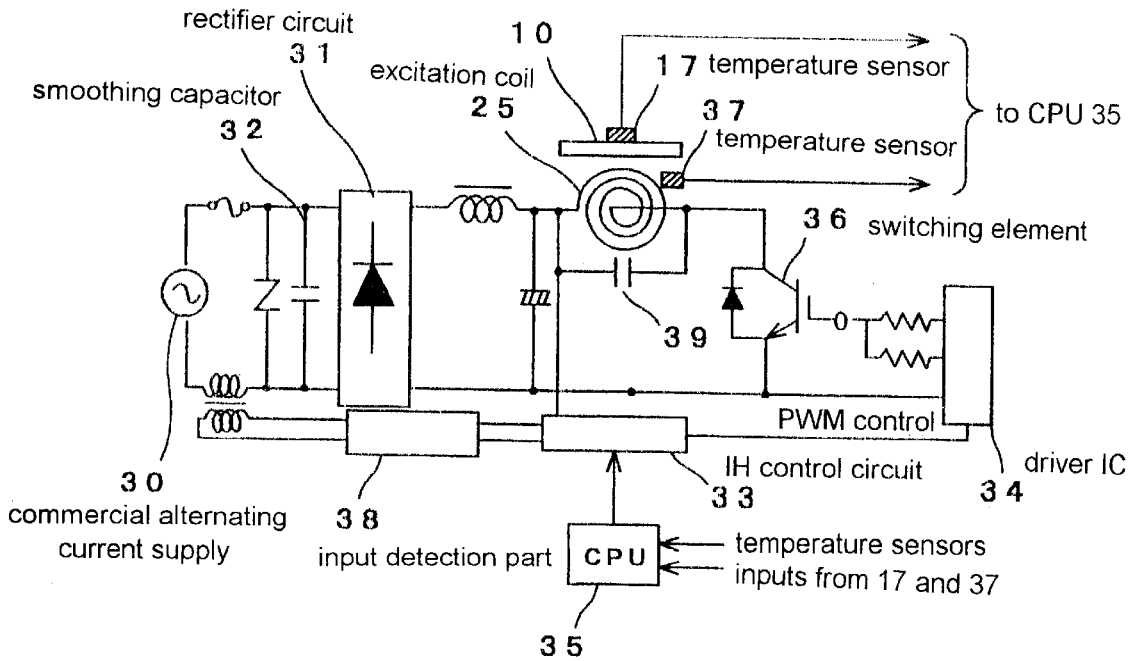
FIG. 3 is a circuit diagram illustrating a power supply circuit for driving the excitation coil of FIG. 1.

Hereinafter, a preferred embodiment of the present invention will be described based on the accompanying drawings. FIG. 1 is a cross sectional view which shows an embodiment of an induction heating fixing device according to the present invention. FIG. 2 is an enlarged cross sectional view which shows the part of an excitation coil of FIG. 1 in detail. FIG. 3 is a circuit diagram which shows a power supply circuit for driving the excitation coil of FIG. 1. The induction heating fixing device 100 illustrated in FIG. 1 and FIG. 2 includes a first and a second pressurizing belt 10, 20, four shafts 13 which are arranged on the inner side of the first pressurizing belt 10 for guiding and positioning the first pressurizing belt 10, four shafts 23 which are arranged on the inner side of the second pressurizing belt 20 for guiding and positioning the second pressurizing belt 20, a pressurizing mechanism 14 arranged on the inner side of the first pressurizing belt, a temperature sensor 17, and an excitation coil 25 arranged on the inner side of the second pressurizing belt 20.

The excitation coil 25 arranged on the inner side of the second pressurizing belt 20 (for instance, a circumferetial length of 100 mm) is disposed in opposition to a feed path for a sheet of paper PP through the second pressurizing belt 20. The pressurizing mechanism 14 (for instance, a pressure pad; a non-conductive material is used) arranged on the inner side of the first pressurizing belt 10 (for instance, a circumferetial length of 75 mm) is disposed in opposition to the feed path of the paper PP through the first pressurizing belt 10. The first and second pressurizing belts 10, 20 are driven by a motor (not shown) to rotate in directions indicated at arrows RA, RB, respectively, whereby the paper PP being fed along a feed path designated at arrow D between the first and second pressurizing belts 10, 20 is further conveyed while being pressurized by the first and second pressurizing belts. The pressurizing mechanism 14 cooperates with the first and second pressurizing belts 10, 20 to apply pressure to the paper PP fed along the feed path. A zone designated at DS in FIG. 2, where pressure is applied to the paper, is hereinafter referred to as a pressure contact area DS.

The excitation coil 25 is supplied with a high-frequency current (e.g., frequencies of 25 kHz-several MHz and an output of 900 W in this example) to generate a magnetic field, whereby an eddy current is produced in the pattern of a magnetic toner TN transferred onto the paper PP which is fed into between the first and second pressurizing belts 10, 20. This eddy current causes resistance components of the magnetic toner TN to generate Joule heat. The pattern of the magnetic toner TN is heated by the Joule heat to a high temperature, and at the same time, pressure is applied to the magnetic toner pattern by means of the pressurizing mechanism 14 through the first and second pressurizing belts, so that the magnetic toner pattern is fixed onto the paper PP. In this case, the pressure contact area DS is broad enough so that the magnetic toner on the paper PP being fed into between the first and second pressurizing belts 10, 20 can enter the pressure contact area DS before the magnetic toner is caused to move under the influence of the magnetic field. Accordingly, when the magnetic toner on the paper PP arrives at a place where the magnetic toner is caused to move through the influence of the magnetic field, pressure has already been applied to the magnetic toner so that the magnetic toner becomes unable to move. Here, note that it is preferable to arrange the pressurizing mechanism 14 and the excitation coil 25 in an opposed relation with respect with each other with the first and second pressurizing belts interposed therebetween, as shown in FIG. 1.

Also, note that the above-mentioned first and second pressurizing belts 10, 20 are formed of a non-conductive material (for instance, heat resistant polyamide imide), and have their surfaces (outer surfaces), which are in mutual pressure contact with each other, covered with silicon rubber or fluororubber. In addition, in a case where an unfixed magnetic toner transferred onto the paper PP has a mean particle diameter of 5–15 $\mu$m and an amount of magnetic powder of 30–60 percent by weight for instance, if it is moved by 0.1 mm, it is recognized that this movement is a level which obviously becomes a problem from the viewpoint of the reproducibility of an image. The area where the magnetic toner receives a force that causes it to move by 0.1 mm varies to some extent depending upon the actual structure and the output of the induction heating fixing device or the quality of the magnetic toner. Therefore, due consideration has to be given to the size of the pressure contact area DS of the induction heating fixing device so as to adequately cope with these variation factors.

Now, reference will be made to a power supply circuit for supplying electric power to the excitation coil of the above-mentioned fixing device while referring to FIG. 3. The output of a commercial alternating current power supply 30 is rectified by a rectifier circuit 31 and then smoothed by a smoothing capacitor 32 to provide a direct current power supply. An IH control circuit 33 is powered by the direct current power supply to perform PWM control on a driver IC 34 under the control of a main CPU 35, so that a switching element 36, which constitutes an inverter circuit, is thereby driven to supply a high-frequency current to the excitation coil 25 with which a resonance capacitor 39 is connected in parallel. The temperature of the excitation coil 25 is supplied to the CPU from a temperature sensor 37, and the temperature of the first pressurizing belt 10 is supplied to the CPU from the temperature sensor 17. In this case, the IH control circuit 33 detects an output to the excitation coil 25 based on the data from an input detection part 38. The CPU 35 gives a control instruction to the IH control circuit 33 based on the data received from the temperature sensors 17, 37. The IH control circuit 33 controls an on time (turn-on time) of the switching element 36 based on the output to the excitation coil 25 detected by the data from the input detection part 38 and the control instruction from the CPU 35, so that the power supply given to the excitation coil 25 through the high-frequency current is adjusted to a target value. The above-mentioned data from the temperature sensors 17, 37 may be directly supplied to the IH control circuit 33 so as to be used for control.

The induction heating fixing device of the present invention is constructed as described above, such that a pressure contact area, through which a sheet of printing paper having a pattern of a magnetic toner is conveyed with the magnetic toner being fixed to the printing paper under the action of induction heating, is set to be broader than a range in which the magnetic toner receives a force that causes it to move under the influence of a magnetic field generated by an induction heating means. With this arrangement, when the printing paper is conveyed to reach a place where the magnetic toner on the surface of the printing paper is subjected to a moving force due to the magnetic field from the induction heating means, pressure has already been applied to the magnetic toner by a pressurizing means so that the magnetic toner becomes unable to move. Accordingly, there is provided an advantage that the magnetic toner is prevented from movement during induction heating thereof, thus making it possible to easily reproduce a true image.

What is claimed is:

1. An induction heating fixing device comprising:

a pressurizing means for applying pressure to a sheet of printing paper in a pressure contact area, through which the printing paper having a pattern of a magnetic toner transferred to a surface thereof is conveyed; and an induction heating means for induction heating the magnetic toner on the surface of the printing paper, which is being conveyed through the pressure contact area, so as to fix the pattern of the magnetic toner onto the surface of the printing paper, said induction heating means creating, in a magnetic field force range, a magnetic field that is capable of moving magnetic toner on the printing paper;

wherein said pressure contact area is configured to be broader than the magnetic field force range created by the induction heating means.

2. The induction heating fixing device according to claim 1, wherein said pressurizing means is formed of a non-conductive material which is not heated even if subjected to the magnetic field from said induction heating means.

3. The induction heating fixing device according to claim 2, wherein said pressurizing means comprises a first and a second pressurizing belt of an endless belt configuration, and a pressurizing mechanism disposed in said first pressurizing belt; and wherein said second pressurizing belt is driven to rotate in a feeding direction while carrying the printing paper thereon; said first pressurizing belt is driven to rotate with the printing paper placed between said first and second pressurizing belts; and said pressurizing mechanism applies pressure to the magnetic toner at least in the pressure contact area in such a manner that the magnetic toner on the surface of the printing paper placed between said first and second pressurizing belts is prevented from being moved under the action of the magnetic field from said induction heating means.

4. The induction heating fixing device according to claim 3, wherein said induction heating means is disposed in said second pressurizing belt in an opposed relation with said first and second pressurizing belts interposed therebetween.

5. An induction heating fixing device comprising:

a pressurizing mechanism that applies pressure to a sheet of printing paper in a pressure contact area, through which the printing paper having a pattern of a magnetic toner transferred to a surface thereof is conveyed; and an induction heating element that heats the magnetic toner on the surface of the printing paper, which is being conveyed through the pressure contact area, so as to fix the pattern of the magnetic toner onto the surface of the printing paper; said induction heating element creating, in a magnetic field force range, a magnetic field that is capable of moving magnetic toner on the printing paper wherein said pressure contact area is configured to be broader than the magnetic field force range created by the induction heating element.

6. The induction fixing device according to claim 5, wherein the induction heating element comprises an excitation coil.

* * * * *